United States Patent [19]

Auriemma

[11] 4,065,925

[45] Jan. 3, 1978

[54] UNDERGROUND DRAINAGE PIPE

[76] Inventor: Robert Sinbad Auriemma, R.D. No. 1, Bethel, Pa. 19507

[21] Appl. No.: 682,492

[22] Filed: May 3, 1976

Related U.S. Application Data

[63] Continuation-in-part of Ser. No. 529,236, Dec. 3, 1974.

[51] Int. Cl.[2] ..... F16L 21/00; E02B 11/00

[52] U.S. Cl. ..... 61/11; 61/10

[58] Field of Search ..... 61/10–13; 210/170; 404/2; 285/176, 373, 417–419, DIG. 4, 424

[56] References Cited

U.S. PATENT DOCUMENTS

| | | | |
|---|---|---|---|
| 460,352 | 9/1891 | Reading | 61/10 |
| 463,871 | 11/1891 | Reading | 61/10 |
| 1,875,395 | 6/1932 | Salisbury | 61/10 |
| 2,153,790 | 4/1939 | Carswell et al. | 61/10 |
| 2,663,997 | 12/1953 | Schmidt et al. | 61/11 |
| 3,333,422 | 8/1967 | Neyland | 61/13 |
| 3,679,242 | 7/1972 | Hess | 61/10 |

*Primary Examiner*—Dennis L. Taylor
*Attorney, Agent, or Firm*—Thomas Hooker

[57] ABSTRACT

An underground drainage pipe having a trough, a roof and wings extending outwardly and downwardly from the junction between the trough lips and the roof. Specialized water intake holes are formed through the thickness of the trough lips beneath the wings. The drain pipe may be formed from extruded uniform cross section stock having alignment means for orienting bits used to drill the drainage holes.

10 Claims, 10 Drawing Figures

UNDERGROUND DRAINAGE PIPE

This application is a continuation-in-part of my copending application entitled "Underground Drainage Pipe", Ser. No. 529,236, Filed Dec. 3, 1974.

The invention relates to an underground drainage pipe of the type used to remove excess soil water. The underground drainage pipe includes a water-receiving trough, a roof covering the trough and joining the trough at the trough lips and wings extending outwardly and downwardly from the junction between the trough and roof. Water intake holes extend through the thickness of the trough beneath the wings. The wings prevent clogging of the intake holes. Underground drainage pipes of the type just described are shown in U.S. Pat. Nos. 460,352; 463,871; 2,153,790, 2,254,885 and 3,333,422.

The improved underground drainage pipes of the invention are conventionally manufactured by first forming, usually by an extrusion operation, a continuous length of uniform cross section stock having a trough, roof, and wings, and then forming the drainage holes in the stock. The inlet holes are drilled and the stock includes either notches or concave rounded surfaces on the outer surface of the lips beneath the wings for aligning the drill bits as they bite into and drill through the trough. The side of the drill bits are aligned or positioned against the underneath surface of the wings so that the hole is formed through the trough immediately adjacent to the wing. This is important as it insures that the wing extends downwardly beyond the botton of the opening in the inlet opening as seen by the water which drains into the pipe.

In a further embodiment of the invention, the drainage holes are formed by drilling perpendicularly through both the wings and the lip portions of the pipe. In this embodiment, the drill is brought down perpendicular against the outer or upper surface of the wing and need not be held as it bites into the pipe.

In an additional embodiment of the invention, the underground drain pipe includes specialized strengthened junctions between the trough and the roof which enable the pipe to withstand and recover from high loading forces without failure. These forces collapse the pipe and sinuously flex the roof and trough. In one test a section of pipe with a trough and roof formed of stiffly flexible plastic ⅛ inch thick and having an over all height of 3 inches was subjected to a vertical loading force of 18,000 pounds per foot of pipe. The high force collapsed the pipe 2 inches without structural injury. When collapsed, the pipe could still carry water, although the capacity was reduced. Upon removal of the force the pipe recovered to approximately 96% of its original height, thus effectively restoring its water carrying capacity.

An additional embodiment of the invention relates to integral interfitting joints whereby lengths of the underground drainage pipe may be joined together in the field without impairing the fluid-carrying capacity or drainage capacity of the assembled drainage line.

Other objects and features of the invention will become apparent as the description proceeds, especially when taken in conjunction with the accompanying drawings illustrating the invention, of which there are three sheets.

IN THE DRAWINGS

Figure 1:
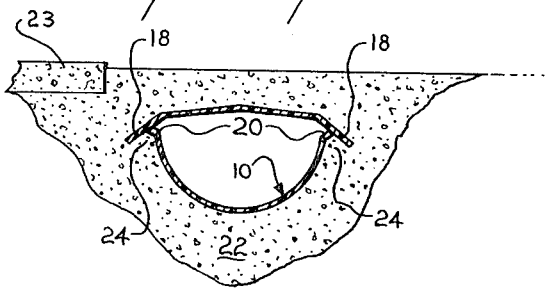
FIG. 1 is a sectional view illustrating a buried, underground drainage pipe according to the invention.
Figure 2:
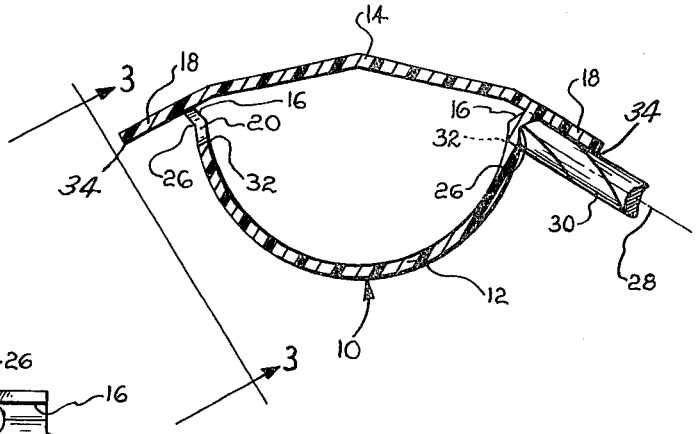
FIG. 2 is another sectional view illustrating the drainage pipe.
Figure 3:
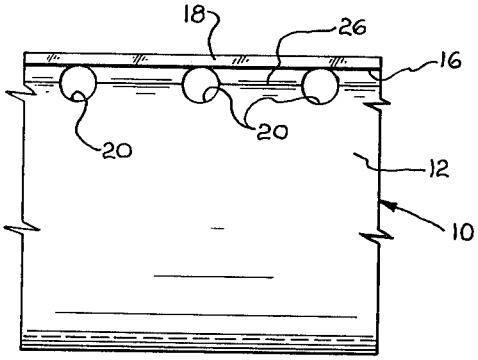
FIG. 3 is a side view of the pipe shown in FIG. 2.

The underground drainage pipe 10, as illustrated in FIGS. 1, 2, and 3 is preferably formed from a continuous cross section extrusion of plastic material and includes a concave trough 12 and an integral roof 14 overlying the trough and joining the trough edges or lips 16. Wings 18 extend outwardly and downwardly from the roof 14 and overlie the trough lips 16. Water intake holes 20 are formed through the thickness of the trough lips 16 to permit water to flow into the interior of the pipe 10 so that it can be drained away, as desired.

FIG. 1 illustrates one use of the underground drainage pipe 10. As there illustrated, the pipe is buried in soil 22 to one side of highway paving 23 and is used to reduce capillary water beneath the paving and to drain away excess water in the soil adjacent the highway. The soil is closely packed around the pipe with the exception of the outer surface of the trough lips, where wings 18 prevent soil above the pipe from filling in the space adjacent the outer surfaces of the lips and in this way prevent clogging of the inlet holes 20. As water rises in the soil 22, the voids 24 are filled and, when the water rises above the bottom of the inlet holes 20, it flows into the pipe and is drained away.

The underground drainage pipe may be formed from lengths of stock having a cross section as shown in FIG. 2 but without the drainage holes 20. The holes are formed by a second operation once the stock has been manufactured, conventionally by a plastic extrusion operation. FIG. 2 illustrates the formation of the drainage holes 20 in accordance with the embodiment of the invention there illustrated.

Longitudinally extending notches 26 are formed in the outer surfaces of lips 16 below wings 18. The drainage holes 20 are formed by drilling through the thickness of the lips 16. The drill bit 26, having an axis 28 parallel to the under surface of the adjacent wing 18 and a diameter equal to twice the distance between the apex of the notch and the under surface of the adjacent wing is positioned as shown in FIG. 2 with the tip of the drill in the notch apex and the circumference of the drill adjacent the tip aligned against the under surface of the wing. The wing and notch facilitate proper location of the drill so that the drainage holes 20 subsequently formed are properly located and are immediately beneath the protecting wings 18. The engagement between the wing and the circumference of the drill facilitates rapid and accurate location of the preform stock prior to drilling and facilitates initial location of the stock with respect to the bit or bits 30 which drill the many drainage holes 20 formed in each length of pipe 10. The drainage holes 20 on each side of the pipe may be drilled simultaneously or sequentially.

The hole 20 is tangent to its overlying wing 18. Because the wing slants downwardly from the junction between the trough and the roof, the water in the soil surrounding the pipe will have to rise to a level above point 32 defined by the intersection of the bottom of the hole 20 with the inner surface of the trough 12. This point is located above the lower corner 34 of the wing 18 and is the bottom or lowest point of the opening which must be overcome by the water flowing into the pipe.

Figure 4:
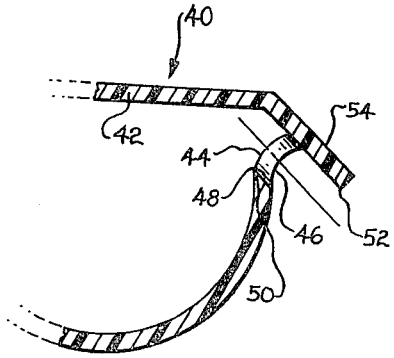
FIG. 4 is a partial sectional view illlustrating a modification of the invention.

FIG. 4 illustrates a second embodiment of the invention wherein underground drain pipe 40 is similar to pipe 10 with the exception that a flat roof 42 is used and the outer surface of the lip portion 44 includes a longitudinally extending inwardly curved or concave surface 46 in place of the angular notch 26. The concave surface 46 serves the same purpose as the notch and alignes the drill bit used to form water-receiving holes 48 through the lip 44 at intervals along the length of the pipe. The bit is tangential to the wing 54. As in the first embodiment, the bottom 50 of the opening in each hole 48 is above the maximum overhanging corner 52 of the wing 54.

Figure 5:
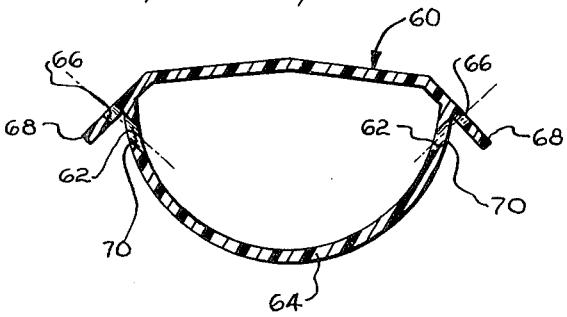
FIG. 5 is a view similar to that of FIG. 2 showing a further modification of the invention.

FIG. 5 illustrates a further embodiment of the invention wherein drainage pipe 60 is formed from stock like that used in forming pipe 10 but where the drainage holes 62 formed in the lips of the trough 64 are extensions of holes 66 drilled through the overhanging wing 68. As in the other embodiments, the bottoms 70 of holes 62 are above the protection wings. Holes 66 extend through the wings, but do not interfere with the drainage or water through holes 62 or with the protection of the holes 62 by the wings.

Figure 6:
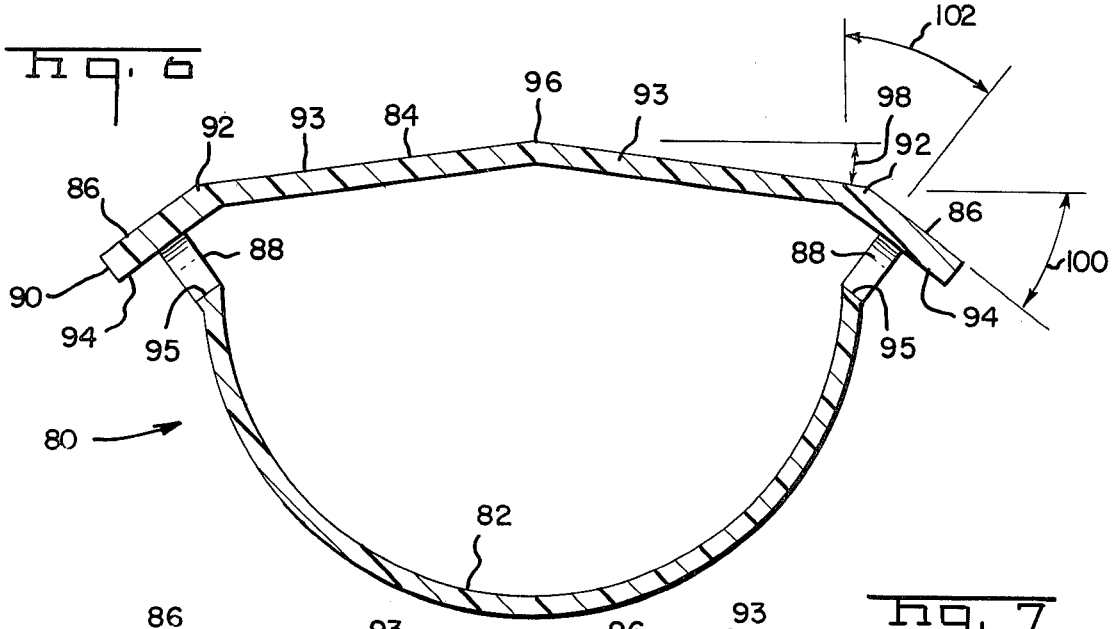
FIG. 6 is a sectional view taken through underground drainage pipe with improved junctions between the roof and trough.

Underground drainage pipe 80 illustrated at FIG. 6 is formed from a uniform cross-section extrusion of stiffly flexible plastic material such as polyvinal chloride or acryloinitrile-butadiene-styrene and including an arcuate trough 82 and a roof 84 overlying the edges of the trough. Flat wings 86 are at the edges of the roof and overlie the diverging column lips 88. As illustrated, the thickness of the wings 86 or of the lips 88 is approximately 1½ times the thickness of the trough 82 or the roof 84. Trough lips 88 integrally join the wings 86 and extend perpendicularly away from the wings midway between the wing edges 90 and the junction 92 between the wings and roof 84. Drainage holes 95 are formed through the trough lips 88 tangent with the under surface 94 of the wings at regular intervals along the length of pipe 80 to permit ground water to flow into the trough 82 as described previously.

FIG. 6 illustrates that the roof 84 of pipe 80 includes a pair of flat sections 93 extending from apex 96 to the junctions 92. With the pipe oriented in the horizontal position as shown in FIG. 6, the roof sections 93 each extend downwardly from the horizontal at an angle 98 of about 6°. The flat wings 86 extends downwardly from horizontal at an angle 100 of about 37°. The flat column lips 88 are perpendicular to wings 86 and extend from the vertical at angle 102 equal to angle 100.

Underground drainage lines are formed from lengths of pipe 80 and are buried beneath the surface in order to remove excess soil water. Pipe 80 is particularly adapted for use in drainage lines extending along edges of highways or in other areas where high surface loadings may be expected. The specialized construction of the underground drain pipe 80 at the junctions between the roof and trough permit the pipe to withstand high loading pressures without structural damage to the pipe while maintaining the capacity to continue carrying liquid, although the capacity may be temporarily reduced until it recovers following removal of the load.

Figure 7:
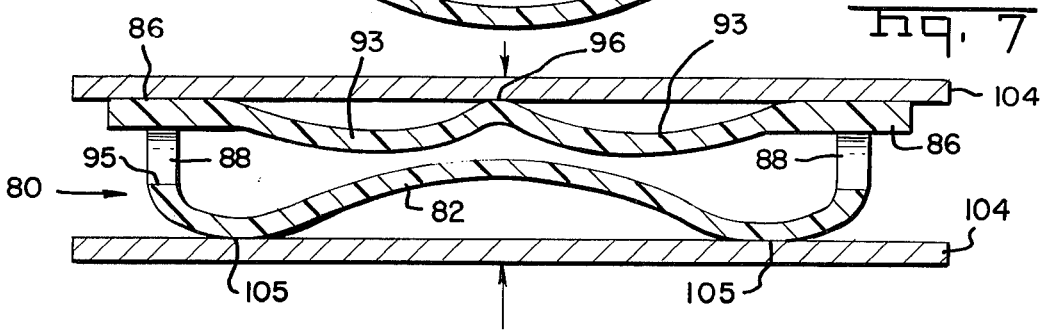
FIG. 7 illustrates the pipe of FIG. 6 when it is subjected to a high loading force.

Because of the difficulty of ascertaining exactly how drainage pipe is deformed by the stress loading when buried, the industry uses a simulated loading test for drainage pipe where the pipe is compressed between a pair of flat plates 104 illustrated in FIG. 7 and the load and deformation of the pipe are experimentally recorded. Conventional drainage pipes have been tested in this manner and structurally fail at relatively low loading forces.

Figure 8:
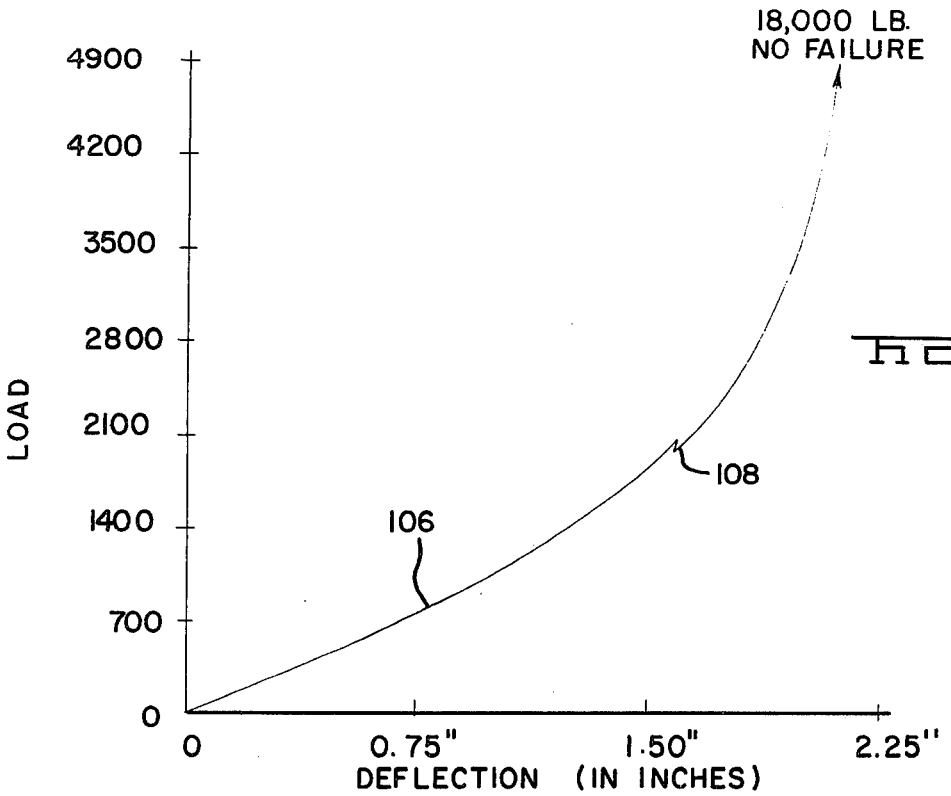
FIG. 8 is a graph of the deflection of the pipe when subjected to a loading force.

In a test a one foot long length of the pipe 80 formed of a grade 1 polyvinal chloride was placed between the plates with the upper plate resting flush on the apex 96. The graph of the deformation of the pipe with increased load is illustrated in FIG. 8 where the ordinate measures the load applied in pounds and the abscissa measures the deflection or collapse of the pipe from its rest position in inches. The graph 106 reflects the deformation of the pipe as the plates are moved together at a rate of ½ inch per minute. The overall rest height of the pipe tested was 3 inches with the roof and trough formed of ⅛ inch thick plastic. The wings and ribs were 3/16 inch thick with the wings having a width of about ¾ inch and the lips having a width of about ⅜ inch. ⅜ inch holes extend through the lips at regular intervals along the length of the pipe.

As indicated in the graph of FIG. 8, application of increased load to the pipe 80 cause the height of the pipe to be decreased by buckling of the trough 82 roof sections 94. The discontinuity 108 in the graph occurred as the pipe became seated in contact with the plates 104. This occurred at a load of approzimately 2,000 pounds. As the load was increased, the roof was forced down relative to the wings until the upper surfaces of wings 86 and apex 96 rested flush on the plate. The roof assumed a sinuous shape with sections 93 downwardly bowed from the wings and apex. The center of trough 82 was upwardly bowed to provide a pair of spaced contacts 105 engaging the lower plate 104 at spaced points. The formerly diverging column lips 88 now are parallel each other and extend perpendicularly down from the now parallel horizontal wings to provide maximum column strength resisting further collapse of the pipe. While the water carrying capacity of the trough is reduced as the pipe is deformed, the trough maintains its integrity and is capable of carrying reduced volumes of water when collapsed. The wings 86 extend outwardly of drainage holes 95 to limit entry of foreign particles into the holes with water flowing into the trough.

Tests on the length of pipe 80 were conducted up to a load of 18,000 pounds per foot without failure. The position of the pipe at the 18,000 pound load is illustrated in FIG. 7. Upon removal of the load the pipe slowly recovers toward its initial geometry thereby increasing the fluid carrying capacity of the trough so that in time the fluid capacity of the pipe is restored.

Similar deflection tests have been made on commercially available drainage pipe of the type manufactured from concrete, steel, aluminum and plastic with the result that none of these pipes are capable of withstanding high loads.

The structure of pipe 80 at the wings and column lips permits it to withstand high loads and recover from the loads. The increased thickenss of the wings and column lips permit them to bear the stress concentrations at the juctions between the trough and roof while relatively thin trough and roof sections are formed and bowed as illustrated. By providing a strong T-shaped junction between the wings and lips so that the lips are column loaded and not shear loaded, the strength of the pipe is increased and the remainder of the pipe may be formed from a relatively thin walled material with a desired reduction in the amount of plastic required to manufacture the pipe. The joint between the trough and roof must be sufficiently strong to confine the circumferentially longer trough from breaking away from the shorter roof. In practice, the roof and trough act as springs and should be relatively thin while the wings and lips, where the stresses concentrate, should be strong to withstand the downward force. Under load, the different length roof and trough are tied together and are stressed to a sinuous shape allowing the load to be borne by the columns formed by the wings and strong lips.

Underground Drainage Pipe 80 has been described with a series of drainage holes 95 formed through the trough lips 88. It is also intended that lengths of pipe 80 could be used as a conduit without holes 95 formed therein so that this pipe would convey water from point to point and would not drain water from the surrounding soil. For instance, such lengths of pipe could be used on the end of a drainage line including a number of lengths of pipe with drainage openings in order to remove the drained water from given area and discharge it at a culvert or other desired point. The use of this type of a conduit having the same cross section as the drainage pipe would facilitate joining of lengths of pipe to form the drain line. The conduit without the drainage holes possesses the same desirable strength characteristics as the drain pipe with the holes 95.

Figure 9:
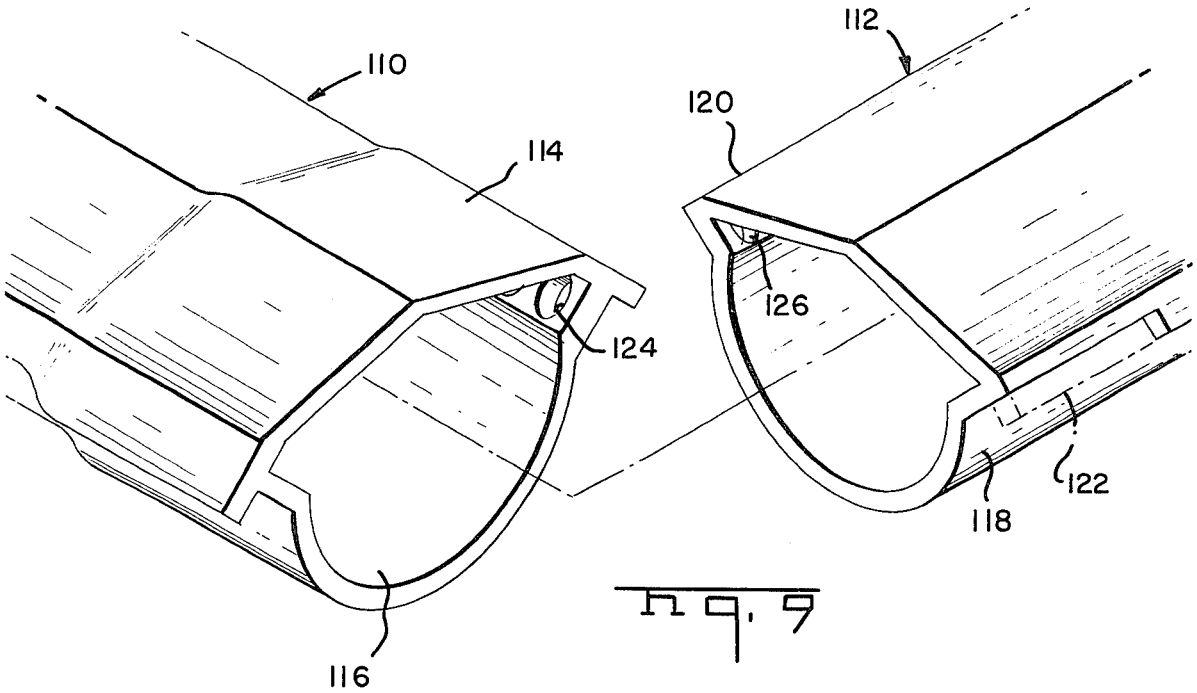
FIG. 9 is a perspective view illustrating specialized construction of the ends of lengths of underground drainage pipe facilitating joining of the lengths.
Figure 10:
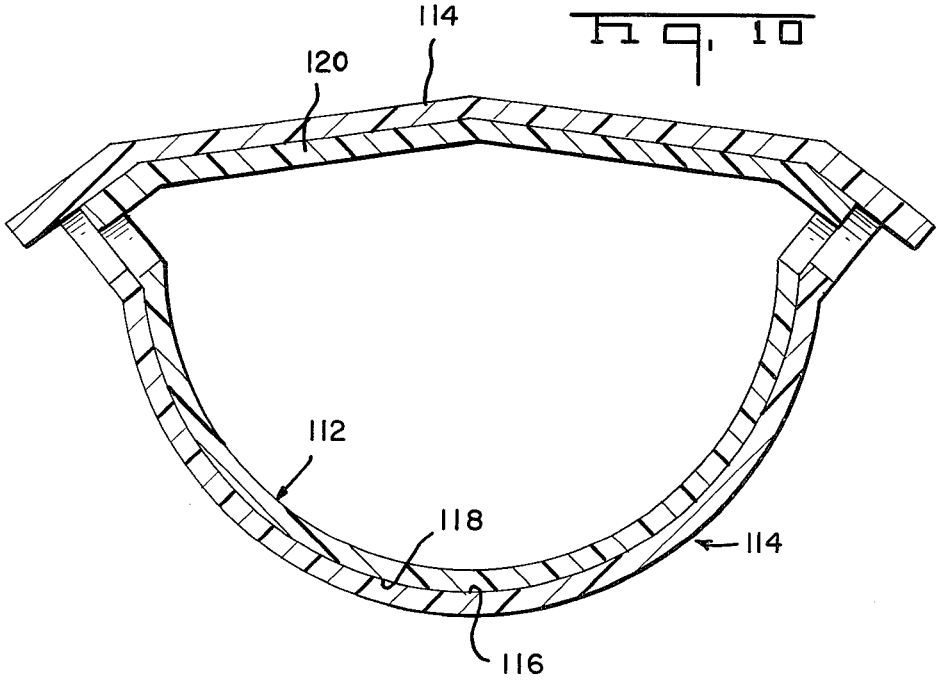
FIG. 10 is a sectional view taken through the pipe ends of FIG. 9 when joined.

FIGS. 9 and 10 illustrate an improved coupling for joining the ends of two lengths of underground drainage pipe 110 and 112 similar to pipe 80 illustrated in FIG. 6. Each pipe 110 and 112 includes a trough, roof, lips and wings like those described in connection with pipe 80. The end of pipe 110 is expanded to form an enlarged bell 114 having an interior surface 116 conforming to the exterior surface 118 of end 120 of pipe 112. Parts 122 of the wings of pipe 112 at end 120 extending outwardly beyond the lips of the pipe are cut away as illustrated.

The two pipes 110 and 112 are joined by aligning the pipes axially and then sliding end 120 into the interior of bell 114. FIG. 10 is a sectional view taken through the ends of the pipes assembled in this manner. The drainage holes 124 and 126 in the ends of the two pipes align with each other as shown in FIG. 10 so that the collection capacity of the drainage line of assembled lengths of pipe is not decreased at the joints between the pipes. The strong T-structure of each pipe is retained into the joints thereby providing additional strength at the joint so that forces exerted on the joint do not injure the drainage line or rupture the pipe. This type of joint may be used to connect two pipes with or without drainage holes.

While I have illustrated and described preferred embodiments of my invention, it is understood that these are capable of modification, and I therefore do not wish to be limited to the precise details set forth, but desire to avail myself of such changes and alterations as fall within the purview of the following claims.

What I claim as my invention is:

1. An underground drainage pipe formed of an extruded stiffly flexible plastic material having a rounded water carrying trough with normally diverging column lips at the edges of the trough; a roof overlying the trough and including a central high point forming a ridge extending along the pipe and wings on the edges of the roof integrally joining, overlying and extending downwardly beyond the column lips of the trough; the circumferential length of the roof being shorter than a circumferential length of the trough, the upper surfaces of the wings being essentially planar, the column lips extending away from the wings at angles essentially 90° to the upper surfaces of the wings so that upon stress loading of the pipe the height of the pipe is reduced, the trough and roof buckle and the wing surfaces are rotated normal to the loading force to rotate the column lips parallel to the force and into column loading positions.

2. An underground drainage pipe as in claim 1 including a series of drainage openings extending through each lip.

3. An underground drainage pipe as in claim 1 wherein the roof includes a central apex and a pair of flat roof sections extending from the apex to the wings at shallow angle.

4. An underground drainage pipe as in claim 3 wherein said shallow angle is about 6° and wherein the wings extend away from the horizontal at an angle of about 37°.

5. An underground drainage pipe as in claim 1 wherein the thickness of said wings and lips is substantially greater than the thickness of the roof and trough.

6. An underground drainage pipe as in claim 3 wherein the thickness of the wings and lips is about 1½ times the thickness of the roof and trough.

7. An underground drainage pipe as in claim 6 wherein the plastic is polyvinal chloride.

8. An underground drainage pipe as in claim 6 wherein the plastic is acryloinitrile-butadiene-styrene.

9. An underground drainage pipe formed of an extruded stiffly flexible plastic material having a rounded water carrying trough with normally diverging column lips at the edges thereof and an integral roof overlying the trough and joining the column lips, a central high point of the roof located above the lips and forming a ridge extending along the pipe, the circumferential length of the roof being shorter than that of the trough, the upper surfaces of the roof above the lips being planar and perpendicular to the axes of the diverging column lips so that the column lips extend away from such surfaces at angles of essentially 90° whereby upon stress loading of the pipe the height of the pipe is reduced, the trough and roof buckle and the said wing surfaces are rotated normal to the loading force to rotate the cloumn lips into column loading positions parallel to the loading force.

10. An underground drainage pipe as in claim 9 including series of spaced drainage holes extending through the column lips.

* * * * *